US009230519B1

(12) United States Patent
Beller

(10) Patent No.: US 9,230,519 B1
(45) Date of Patent: Jan. 5, 2016

(54) INSTRUMENT STRING LIGHTING DEVICE

(71) Applicant: Jeremy V. Beller, Fort Lauderdale, FL (US)

(72) Inventor: Jeremy V. Beller, Fort Lauderdale, FL (US)

( * ) Notice: Subject to any disclaimer, the term of this patent is extended or adjusted under 35 U.S.C. 154(b) by 0 days.

(21) Appl. No.: 14/132,611

(22) Filed: Dec. 18, 2013

(51) Int. Cl.
*G10H 1/00* (2006.01)
*G10D 3/10* (2006.01)

(52) U.S. Cl.
CPC ..... *G10D 3/10* (2013.01)

(58) Field of Classification Search
USPC ..... 84/464 R
See application file for complete search history.

(56) References Cited

U.S. PATENT DOCUMENTS

| | | | | |
|---|---|---|---|---|
| 4,061,071 | A * | 12/1977 | Cameron | 84/455 |
| 4,335,642 | A * | 6/1982 | Pogoda | 84/454 |
| 4,745,837 | A | 5/1988 | Rimsa | |
| 5,373,768 | A | 12/1994 | Sciortino | |
| D440,001 | S | 4/2001 | Marcella | |
| 6,781,049 | B2 | 8/2004 | Taylor | |
| 7,825,313 | B2 | 11/2010 | Shaffer | |
| 7,858,865 | B2 * | 12/2010 | D'Arco | 84/454 |
| 7,968,778 | B2 * | 6/2011 | D'Addario et al. | 84/312 R |
| 8,809,655 | B1 * | 8/2014 | Warwick | 84/318 |
| 2006/0048628 | A1 * | 3/2006 | Huwaldt | 84/314 R |
| 2011/0075395 | A1 | 3/2011 | Spurgeon | |
| 2011/0197743 | A1 * | 8/2011 | Potter et al. | 84/730 |
| 2013/0247744 | A1 * | 9/2013 | Helgesson | 84/314 R |

* cited by examiner

*Primary Examiner* — Christopher Uhlir

(57) ABSTRACT

An instrument string lighting device lights the strings of an instrument for enhanced visibility in low light conditions. The device includes a clip configured for coupling to a stringed instrument adjacent to strings of the stringed instrument. A housing is coupled to the clip and a light is coupled to the housing. The light directs illumination outwardly from the housing wherein the strings of the stringed instrument are illuminated by the light.

14 Claims, 5 Drawing Sheets

INSTRUMENT STRING LIGHTING DEVICE

BACKGROUND OF THE DISCLOSURE

Field of the Disclosure

The disclosure relates to lighting devices and more particularly pertains to a new lighting device for lighting the strings of an instrument for enhanced visibility in low light conditions.

SUMMARY OF THE DISCLOSURE

An embodiment of the disclosure meets the needs presented above by generally comprising a clip configured for coupling to a stringed instrument adjacent to strings of the stringed instrument. A housing is coupled to the clip and a light is coupled to the housing. The light directs illumination outwardly from the housing wherein the strings of the stringed instrument are illuminated by the light.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
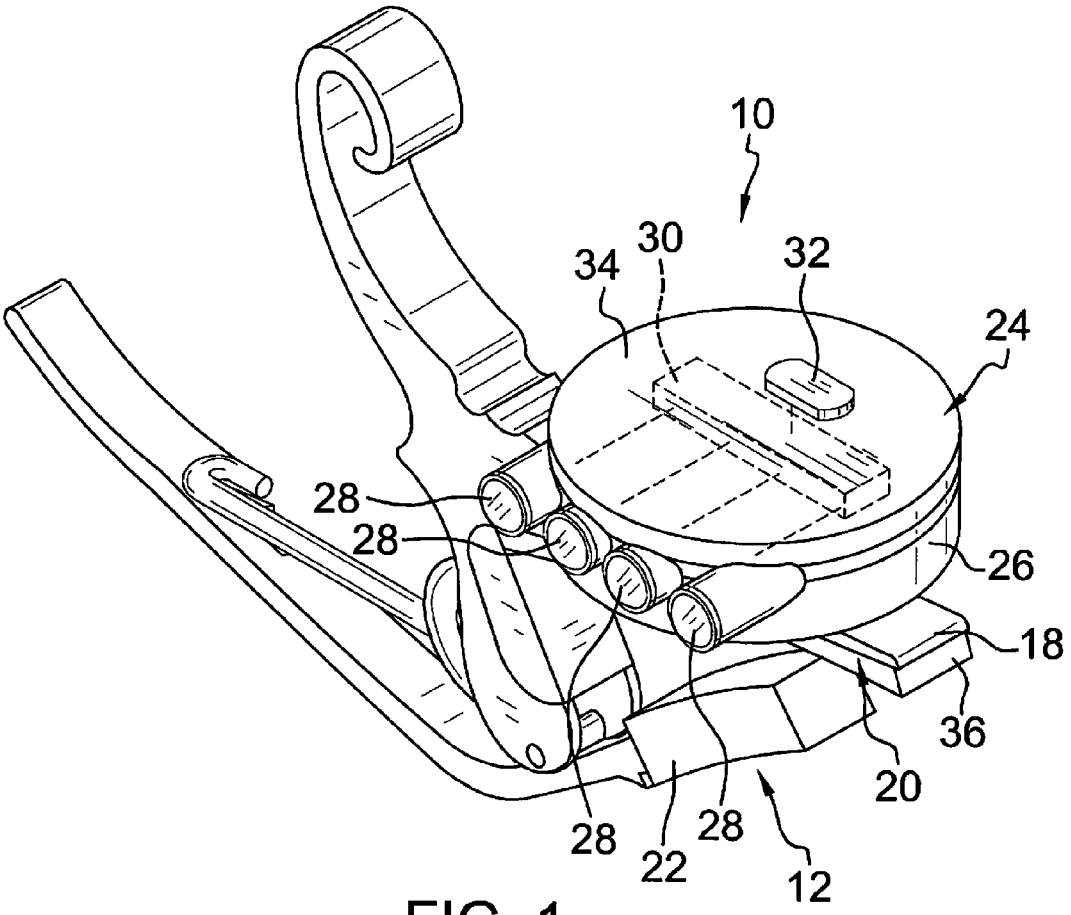
FIG. 1 is a top front side perspective view of a instrument string lighting device according to an embodiment of the disclosure.
Figure 2:
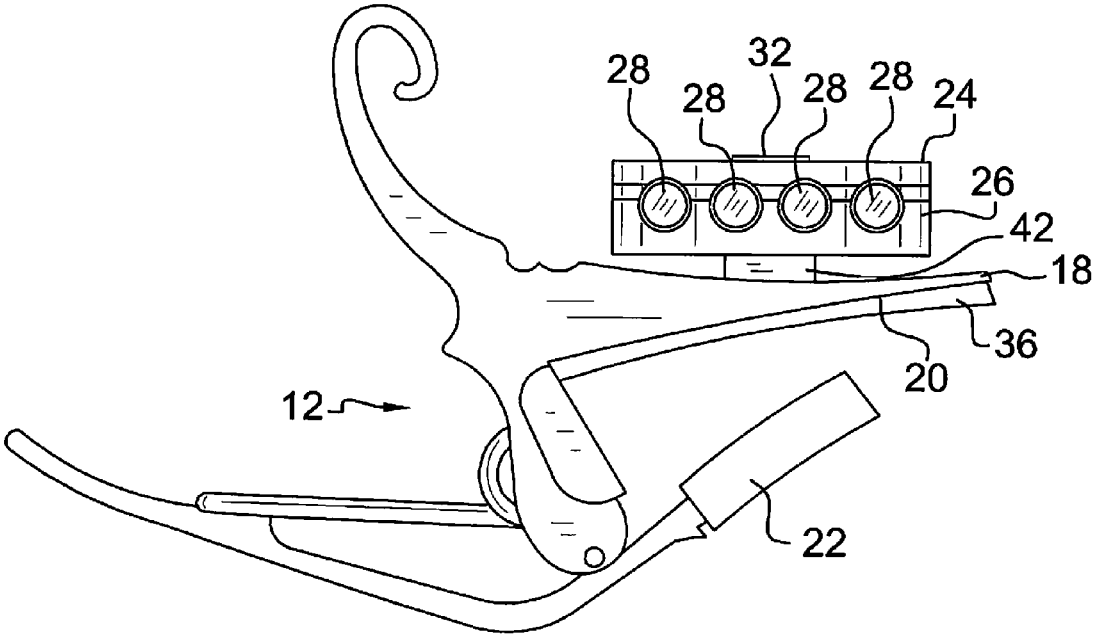
FIG. 2 is a front view of an embodiment of the disclosure.
Figure 3:
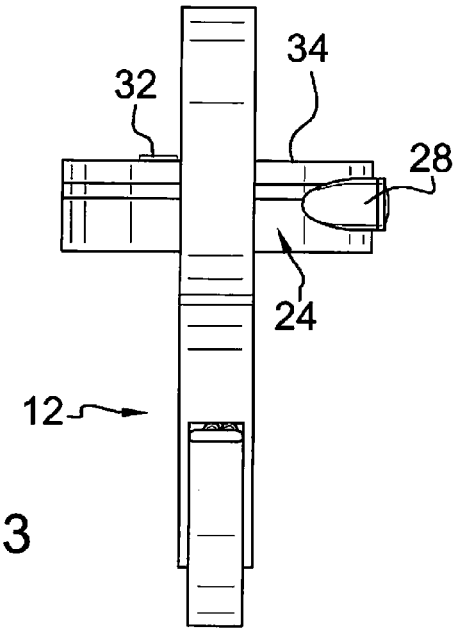
FIG. 3 is a side view of an embodiment of the disclosure.
Figure 4:
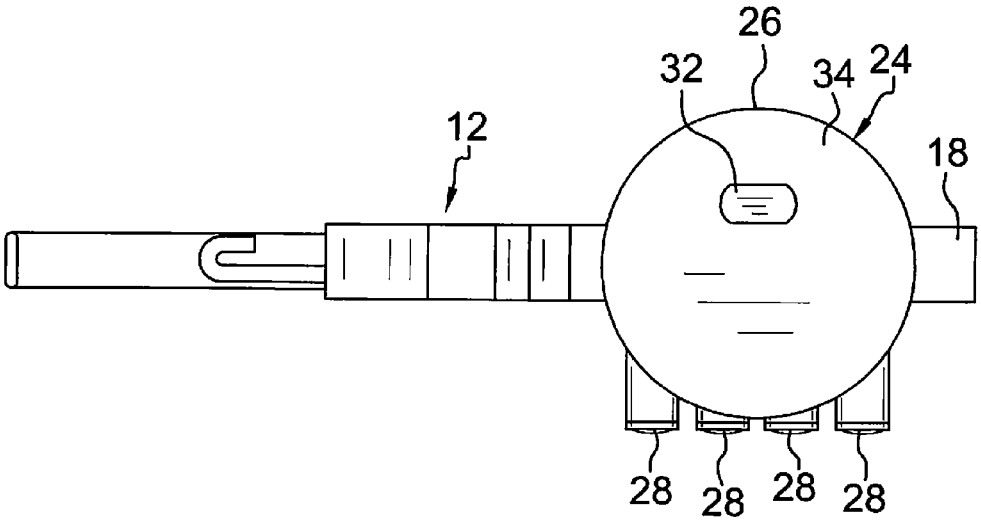
FIG. 4 is a top view of an embodiment of the disclosure.
Figure 5:
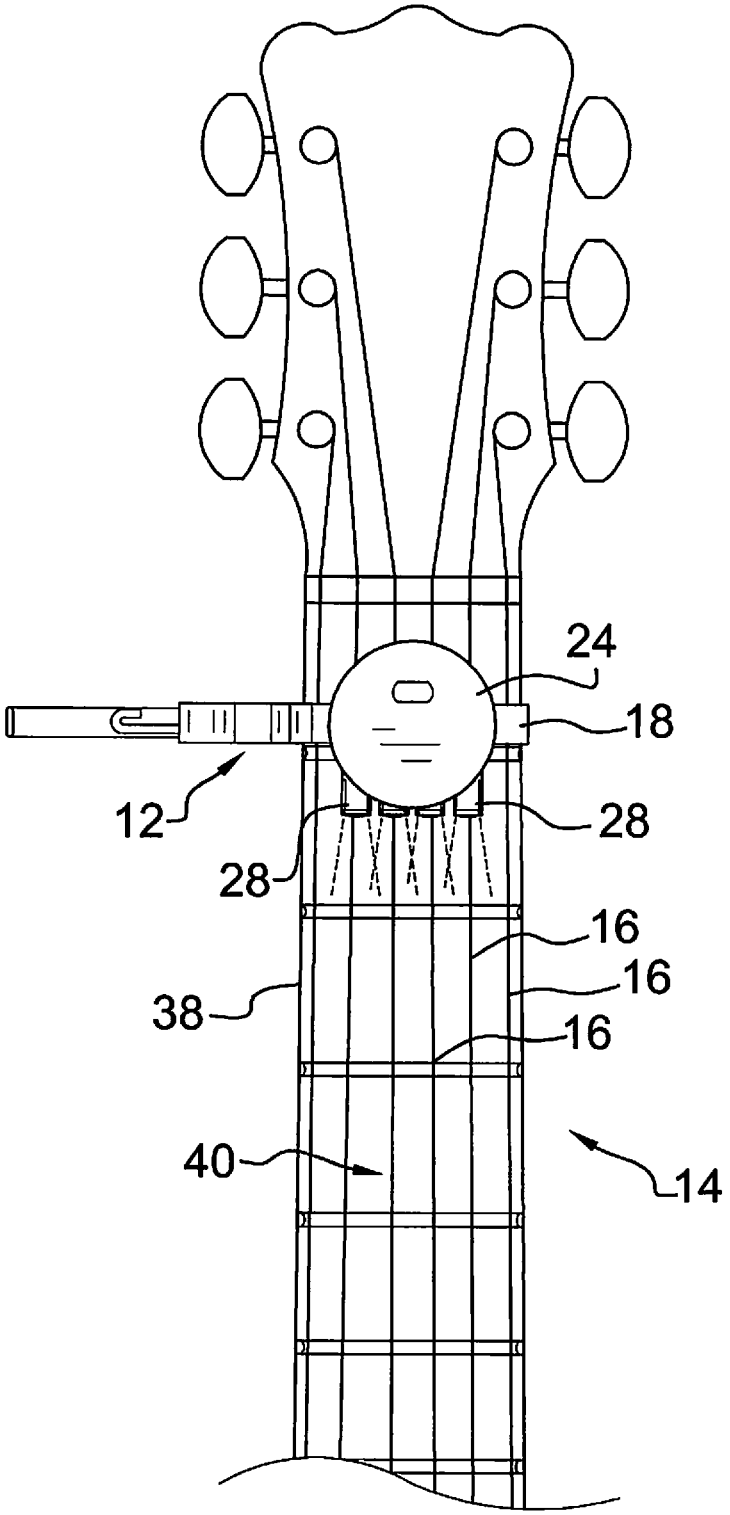
FIG. 5 is a top view of an embodiment of the disclosure in use.

With reference now to the drawings, and in particular to FIGS. 1 through 6 thereof, a new lighting device embodying the principles and concepts of an embodiment of the disclosure and generally designated by the reference numeral 10 will be described.

As best illustrated in FIGS. 1 through 6, the instrument string lighting device 10 generally comprises a clip 12 configured for coupling to a stringed instrument 14 adjacent to strings 16 of the stringed instrument 14. The clip 12 may comprise a first arm 18 having a substantially planar face 20 hingedly and biasedly coupled to a second arm 22. Thus, the clip 12 may be utilized as a conventional capo couplable to the stringed instrument 14 such that an effective length of the strings 16 of the stringed instrument 14 is shortened by the capo. The face 20 may have a slight curvature as can be found in housing 24. The light 28 directs illumination outwardly from the housing 24 wherein the strings 16 of the stringed instrument 14 are illuminated by the light 28. The light 28 may be one of a plurality of lights 28 coupled to the housing 24. Each light 28 directs illumination outwardly from the housing 24. Each light 28 may be substantially cylindrical and positioned to extend from the perimeter wall 26 of the housing 24. The lights 28 may be parallel and evenly spaced. Each light 28 may comprise a light emitting diode of a selectable color either collectively or individually through conventional electrical coupling to a dial, switch, or the like.

A battery 30 is coupled to the housing 24. The battery 30 is electrically coupled to each light 28. A switch 32 is coupled to the housing 24 and may be positioned on a top wall 34 of the housing 24 facing away from the clip 12. The switch 32 is electrically coupled between the battery 30 and each light 28 wherein the lights 28 are selectively illuminated by manipulation of the switch 32.

Figure 6:
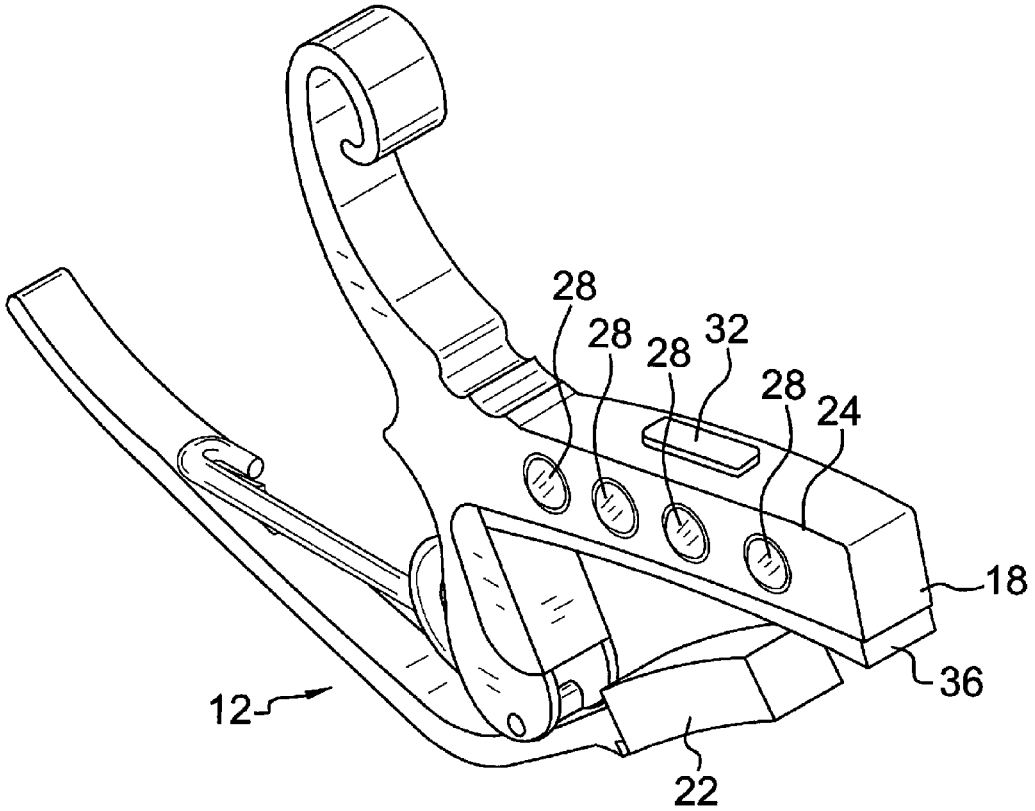
FIG. 6 is a top front side perspective view of an alternative embodiment of the disclosure.

A pad 36 may be coupled to and extend across the planar face 20 wherein the pad 36 is configured to extend across and abut the strings 16 on a neck 38 of the stringed instrument 14 wherein each string 16 is held against a fret board 40 of the stringed instrument 14. A support arm 42 may be coupled to and extend between the first arm 26 and the housing 24 wherein the housing 24 is positioned in spaced relationship to the first arm 26. Alternatively, as shown in FIG. 6, the housing 24 may be integrally coupled to and incorporated into the first arm 26.

In use, the clip 12 may be clipped to any instrument to provide additional lighting to enhance the visual aspects of a performance. Alternatively, the clip 12 may be used as a conventional capo on the stringed instrument 14. The switch 32 is manipulated to selectively illuminate the lights 28 in a desired color and manner. The lights 28 may be used for lighting the strings 16 to facilitate viewing of the strings 16 in low light conditions commonly found during a live instrumental performance as well as enhancing the visual aspect of a performance.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A instrument string lighting device comprising:

a clip configured for coupling to a stringed instrument adjacent to strings of the stringed instrument, said clip being a capo couplable to the stringed instrument such that an effective length of the strings of the stringed instrument is shortened by said capo;

a housing coupled to said clip;

a light coupled to said housing, said light directing illumination outwardly from said housing wherein the strings of the stringed instrument are illuminated by said light a switch being mounted on said housing and being electrically coupled to said light, said light being illuminated by selective manipulation of said switch.

2. The device of claim 1, further comprising said light being one of a plurality of lights coupled to said housing, each said light directing illumination outwardly from said housing.

3. The device of claim 1, further comprising said housing being integrally coupled to an upper arm of said capo.

4. The device of claim 1, further comprising said light being a selectable color.

5. The device of claim 2, further comprising each said light being a selectable color.

6. The device of claim 1, further comprising a battery coupled to said housing, said battery being electrically coupled to said light.

7. The device of claim 6, wherein said switch is electrically coupled between said battery and said light.

8. The device of claim 2, further comprising:

said clip comprising a first arm having a substantially planar face;

a pad coupled to and extending across said planar face wherein said pad is configured to extend across and abut the strings on a neck of the stringed instrument wherein each string is held a fret board of the stringed instrument.

9. The device of claim 8, further comprising said housing being disc-shaped.

10. The device of claim 9, further comprising said housing being integrally coupled to said first arm.

11. The device of claim 2, further comprising each said light being substantially cylindrical and extending from a perimeter wall of said housing.

12. The device of claim 8, further comprising a support arm coupled to and extending between said first arm and said housing wherein said housing is positioned in spaced relationship to said first arm.

13. A instrument string lighting device comprising:

a clip configured for coupling to a stringed instrument adjacent to strings of the stringed instrument, said clip comprising a first arm having a substantially planar face, said clip being a capo couplable to the stringed instrument such that an effective length of the strings of the stringed instrument is shortened by said capo;

a housing coupled to said clip, said housing being disc-shaped;

a light coupled to said housing, said light directing illumination outwardly from said housing wherein the strings of the stringed instrument are illuminated by said light, said light being one of a plurality of lights coupled to said housing, each said light directing illumination outwardly from said housing, each said light being substantially cylindrical and extending from a perimeter wall of said housing, each said light being a selectable color;

a battery coupled to said housing, said battery being electrically coupled to said light;

a switch coupled to said housing, said switch being electrically coupled between said battery and said light wherein said light is selectively illuminated by manipulation of said switch;

a pad coupled to and extending across said planar face wherein said pad is configured to extend across and abut the strings on a neck of the stringed instrument wherein each string is held a fret board of the stringed instrument; and a support arm coupled to and extending between said first arm and said housing wherein said housing is positioned in spaced relationship to said first arm.

14. The device of claim 13, further comprising said housing being integrally coupled to an upper arm of said capo.

* * * * *